US006170664B1

(12) United States Patent
Dar

(10) Patent No.: US 6,170,664 B1
(45) Date of Patent: Jan. 9, 2001

(54) CONTACT LENS HOLDER

(75) Inventor: Irit Dar, Fair Lawn, NJ (US)

(73) Assignee: ID Studios, Fair Lawn, NJ (US)

( * ) Notice: Under 35 U.S.C. 154(b), the term of this patent shall be extended for 0 days.

(21) Appl. No.: 09/156,059

(22) Filed: Sep. 17, 1998

(51) Int. Cl.[7] ..... A45C 11/04
(52) U.S. Cl. ..... 206/511
(58) Field of Search ..... 351/219, 160 R; 206/5, 5.1, 6

(56) References Cited

U.S. PATENT DOCUMENTS

| | | | | |
|---|---|---|---|---|
| D. 155,480 | | 10/1949 | Castelli | D57/1 |
| D. 227,744 | | 7/1973 | Mitchko | D9/3 |
| D. 341,482 | | 11/1993 | McMillan | D3/334 |
| D. 380,898 | | 7/1997 | Lovell | D3/264 |
| D. 397,551 | | 9/1998 | Shefler | D3/265 |
| 3,939,968 | * | 2/1976 | Ryder . | |
| 4,863,013 | | 9/1989 | Eastman | 206/5 |
| 5,016,749 | * | 5/1991 | Kaye et al. . | |
| 5,086,913 | | 2/1992 | Camm et al. | 206/5.1 |
| 5,415,275 | | 5/1995 | Girimont | 206/5.1 |
| 5,615,765 | | 4/1997 | Roericht | 206/45.23 |
| 5,657,506 | | 8/1997 | Pankow | 15/104.92 |
| 5,833,053 | | 11/1998 | Wood et al. | 206/5 |

* cited by examiner

*Primary Examiner*—George Manuel
(74) *Attorney, Agent, or Firm*—Steinberg & Raskin, P.C.

(57) ABSTRACT

Contact lens holders including a pair of oval contact lens receiving-cups, each having a longitudinal dimension and a transverse dimension smaller than the longitudinal dimension, and covers for engaging and covering the cup. The oval shape of the cups facilitates easy removal of contact lens from the cups since a greater portion of a contact lens wearer's finger may be inserted into the interior of the cups in the longitudinal direction. In one embodiment, the housing is a molded body member made of plastic and defines the oval cups therein. The covers are pivotally mounted to the body member. In another embodiment, the housing includes a tubular, outer housing part defining an interior space and an inner housing part slidable into the interior space of the outer housing part through an open end thereof. The cups are arranged on the inner housing part and covered by the covers.

31 Claims, 11 Drawing Sheets

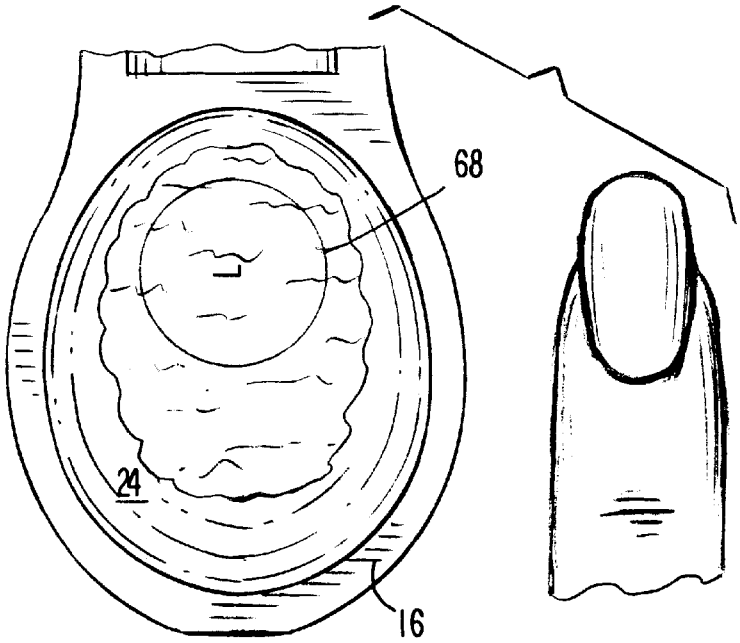
FIG. 15
FIG. 16
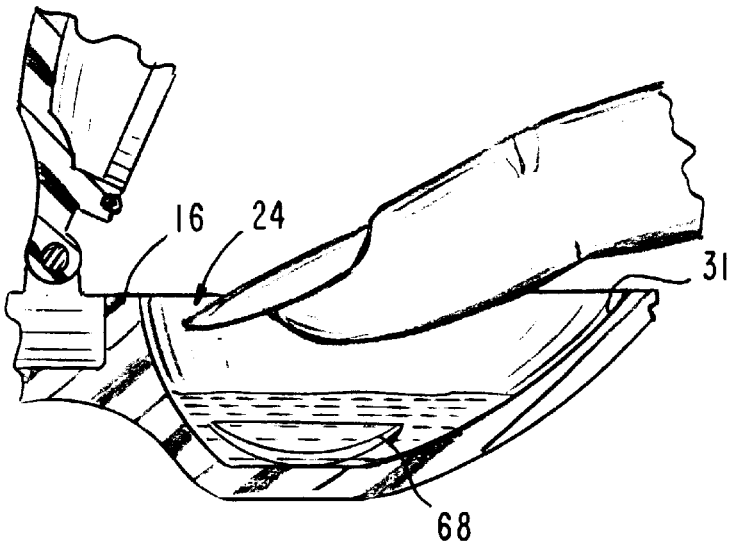

FIG. 19
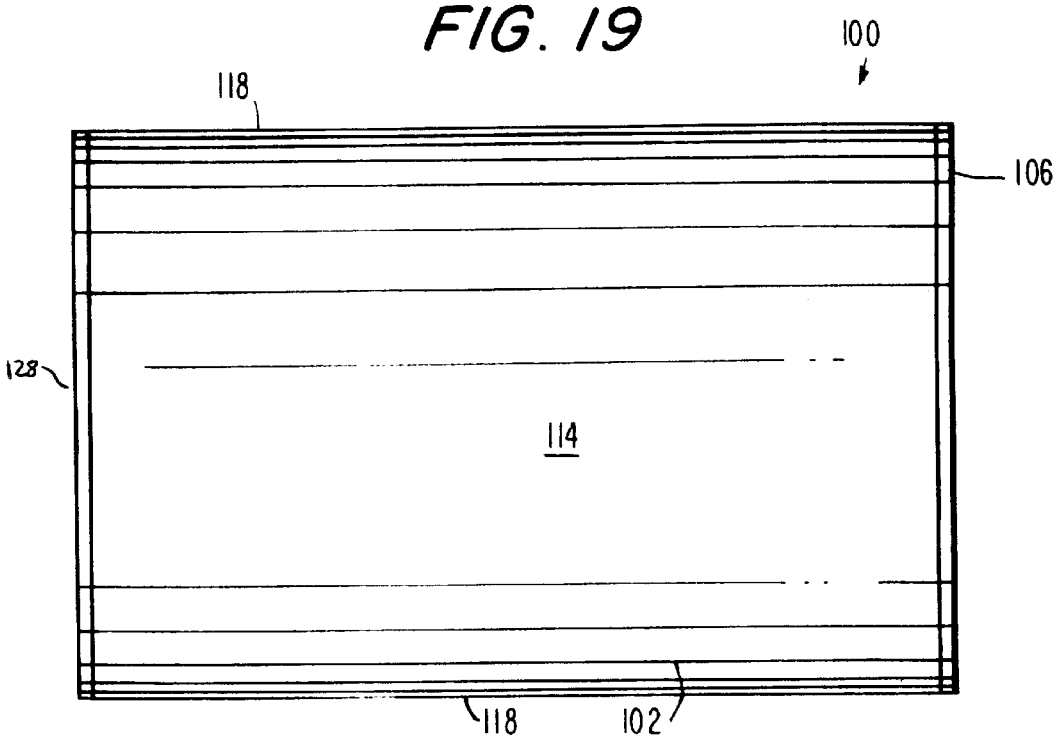
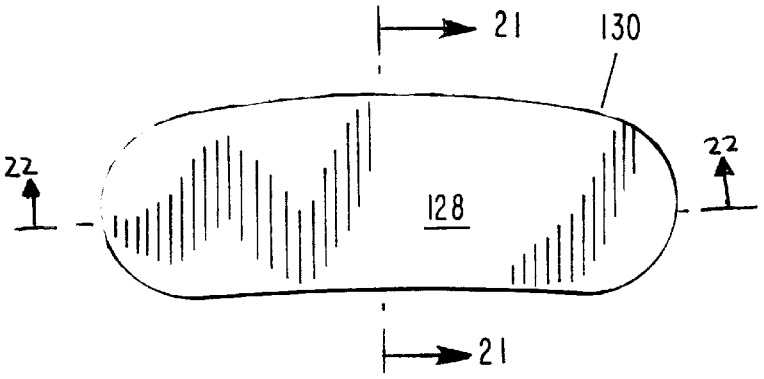
FIG. 20

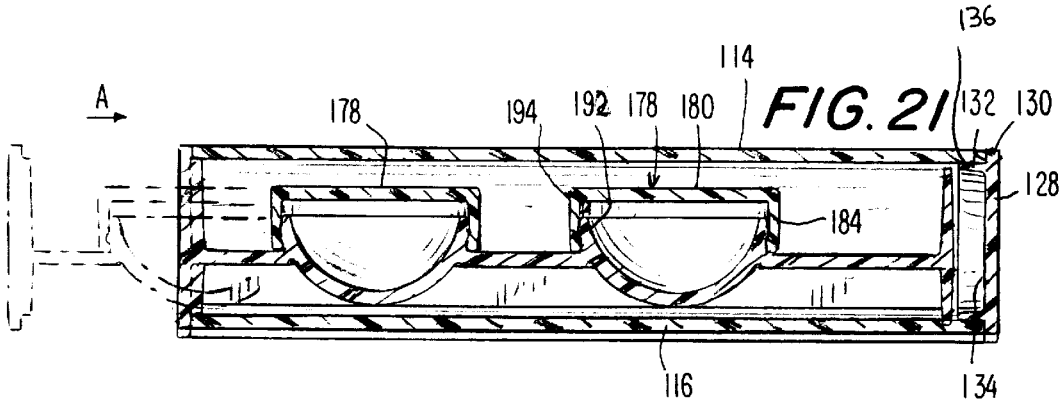
FIG. 21
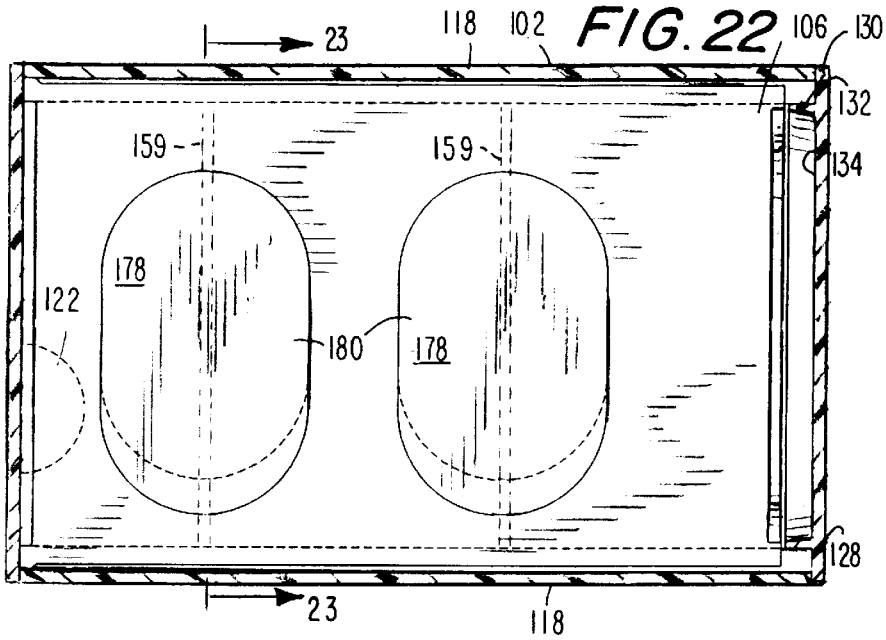
FIG. 22
FIG. 23
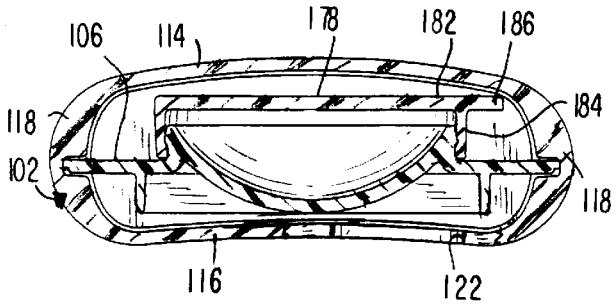

FIG. 26
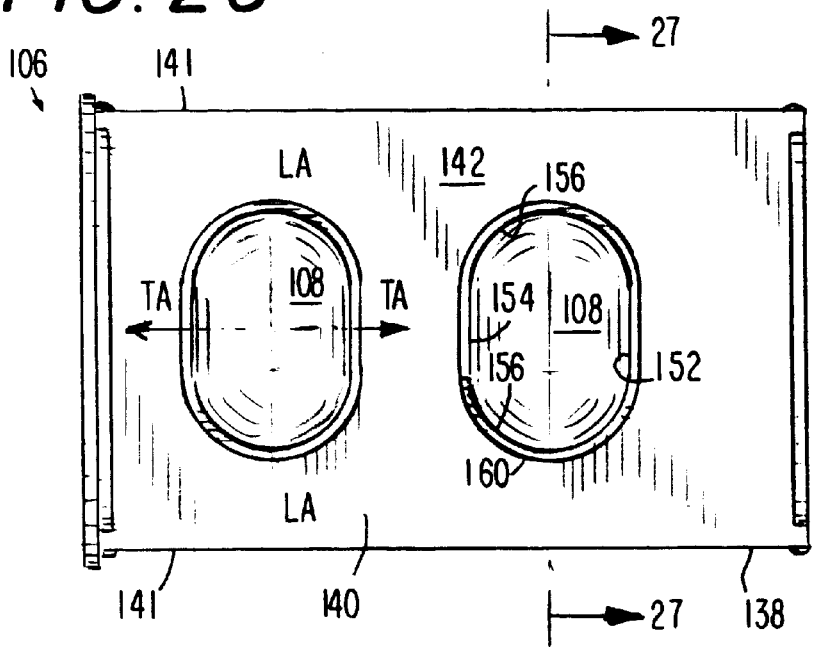
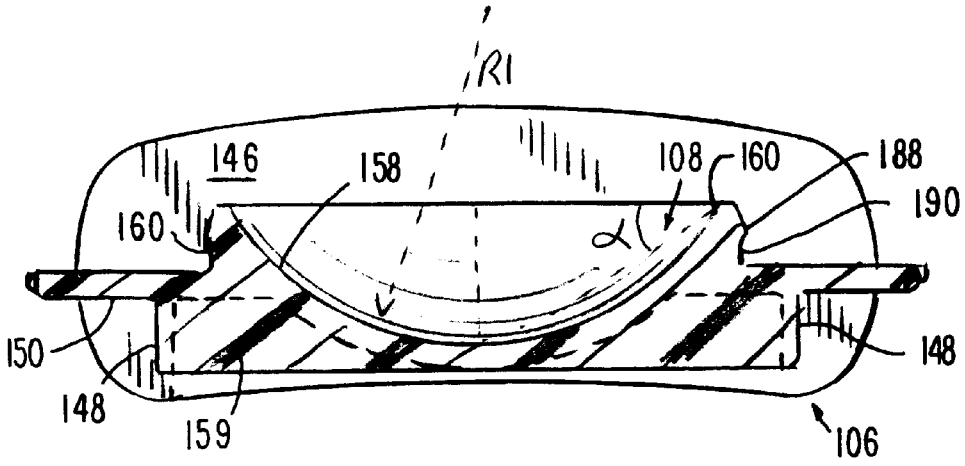
FIG. 27

CONTACT LENS HOLDER

FIELD OF THE INVENTION

The present invention relates to contact lens holders having a pair of cups for retaining a pair of contact lenses.

1. Definitions

As used herein, a "cup" is a chamber capable of receiving and retaining a contact lens in connection with an appropriate contact lens storage solution. Such a contact lens-receiving chamber may take the form of, and is equivalent to, a recess, well, bowl or compartment as these terms are defined and/or used in the art to which the invention pertains.

As used herein, a "housing" is any structure, one piece or multiple pieces, which includes one or more cups capable of retaining a contact lens immersed in solution.

2. Background of the Invention

There are several different types of contact lens holders or cases. Some contact lens holders include two pairs of hemispherical walls separable from one another, each pair defining a chamber for retaining a contact lens therebetween, whereby the walls and contact lens therebetween are immersed in solution. Others include a housing including two hemispherical cups into which the contact lens and storage solution are placed and covers for covering the cups.

The latter type of contact lens holders is generally made of plastic which is molded to include the hemispherical cups. After each use, the contact lenses are usually cleaned and rinsed, placed in the cups in the holder and then storage solution is introduced into the cups until the contact lenses are entirely immersed in the solution. The contact lenses remain in the holder until the next use.

It is a drawback of the hemispherical cups that the curvature and depth of the cups make it difficult to easily insert and remove the contact lens from the cups, especially for women with long fingernails. Access to the cups is usually provided by a circular opening in the surface on which the cup is formed and the diameter of the circular opening might not be large enough to permit entry of the tip of the wearer's finger in view of the presence of a long fingernail. Thus, the wearer would have to insert her fingernail into the cup to press the contact lens against the surface of the cup and then slide the contact lens out of the cup along this surface. This may result in damage to the contact lens.

Furthermore, covers or lids for the cups in conventional contact lens holders are often screwed over the cups by providing cooperating threading on an inner surface of the cover and on an outer surface of a projection or rim surrounding, and partially defining, the cup. A problem with such fastening arrangements is that the contact lens solution may leak through the cooperating threads, which leakage is detrimental to the storage of the contact lens. In a most severe case, all of the solution may leak out of the cup causing the contact lens to dry out and possibly be damaged. Also, if the contact lens holder is carried in a purse or pockets, other objects in the purse or pocket would become wet as the solution leaks out of the cups.

Conventional contact lens holders often have irregular, non-smooth surfaces, including, for example, ridges, nooks and crannies. It is a problem with such contact lens holders that dirt may accumulate in such areas and during handling of the contact lens holder during insertion and removal of the contact lens therefrom, the dirt may adhere to the contact lens themselves.

OBJECTS AND SUMMARY OF THE INVENTION

It is an object of the present invention to provide new and improved contact lens holders.

It is another object of the present invention to provide new and improved contact lens holders which are designed to provide easier insertion and removal of the contact lens into and from the cups in the holder in comparison to conventional contact lens holders.

It is another object of the present invention to provide new and improved contact lens holders which are ergonomically designed to provide for easier insertion and removal of the contact lens into and from the cups in the holder in comparison to conventional contact lens holders.

It is still another object of the present invention to provide new and improved contact lens holders in which the angle of the cups is lower in comparison to most if not all conventional contact lens holders so that insertion and removal of the contact lens from the cups are less taxing and reduces the chances of the contacts falling out of the cups.

It is a further object of the present invention to provide new and improved contact lens holders which substantially prevent leaks and spills of contact lens solution from the cups when the contact lenses are immersed in the solution therein.

It is yet another object of the present invention to provide new and improved contact lens holders which provide smooth outer surfaces designed to prevent the accumulation of dirt.

In view of achieving these objects and others, contact lens holders in accordance with the invention include a housing defining a pair of oval contact lens-receiving cups and cover means for covering the cups. Each cup has a longitudinal dimension and a transverse dimension smaller than the longitudinal dimension. The oval shape of the cups facilitates easy removal of contact lenses from the cups since a greater portion of a contact lens wearer's finger (and a fingernail if projecting beyond the tip of the finger) may be inserted into the interior of the cups in the longitudinal direction. Further, by dimensioning the shape of the cup and the depth of the cup, the cup may be provided with a lower angle in the longitudinal direction, i.e., the depth of the cup relative to the longitudinal radius of the cup, is lower than in conventional hemispherical cups and lower than the angle in the transverse dimension of the cup.

In one embodiment of the invention, the housing comprises a molded body member made of plastic and which defines the oval cups therein. More specifically, each cup extends from an oval opening in an upper surface of the body member and is defined by a round, flat bottom surface and an arcuate surface extending around and contiguous with the flat bottom surface. The arcuate surface is provided with an elongated portion in the longitudinal direction, along which the contact lens may be conveniently slid for removal thereof, by situating the bottom surface longitudinally offset relative to a center of the oval opening. The cover means comprise a pair of covers, each pivotally mounted about a shaft to the body member. Cooperating latching means are arranged on the covers and body member to latch the covers to the body member. To prevent leakage of the contact lens solution from the cups, a seal ring is arranged in a groove formed in a lower surface of each cover and is positioned to engage an upper surface of the body member when the covers are in a closed position.

In another embodiment of the invention, the housing comprises a tubular, outer housing part defining an interior space and an inner housing part slidable into the interior space of the outer housing part through an open end thereof. The cups are arranged on the inner housing part and covered by covers. To facilitate entry and removal of the inner housing part into and from the outer housing part, the outer housing part includes side walls having a longitudinal slot and the inner housing part has a longitudinal extending planar portion with lateral edges adapted to be received within the slots formed in the side walls of the outer housing part. Each cup has a unique shape in the art of contact lens holders and extends downwardly from an oval opening in the upper surface of the planar portion of the inner housing part. To wit, each cup is defined by an arcuate surface having a constant radius of curvature along a longitudinal axis, a constant radius of curvature along the transverse axis and a variable radius of curvature between the longitudinal axis and transverse axis.

BRIEF DESCRIPTION OF THE DRAWINGS

A more complete appreciation of the present invention and many of the attendant advantages thereof will be readily understood by reference to the following detailed description when considered in connection with the accompanying drawings in which:

FIG. 15 is a top view of the contact lens holder shown in FIG. 1 showing an advantageous alignment of the holder for removal of a contact lens from the cup;

FIG. 16 is a view showing the advantageous manner in which the contact lens is removed from the cup in accordance with the invention;

FIG. 19 is a top view of the contact lens holder shown in FIG. 17;

FIG. 20 is a side view of the contact lens holder shown in FIG. 17;

FIG. 21 is a cross-sectional view of the contact lens holder shown in FIG. 17 taken along the line 21—21 of FIG. 20;

FIG. 22 is a cross-sectional view of the contact lens holder shown in FIG. 17 taken along the line 22—22 of FIG. 20;

FIG. 23 is a cross-sectional view of the contact lens holder shown in FIG. 17 taken along the line 23—23 of FIG. 22;

FIG. 26 is a top view of the inner housing part of the contact lens holder shown in FIG. 17; and FIG. 27 is a cross-sectional view of the inner housing part of the contact lens holder shown in FIG. 17 taken along the line 27—27 of FIG. 26.

DETAILED DESCRIPTION OF THE PREFERRED EMBODIMENTS

Figure 1:
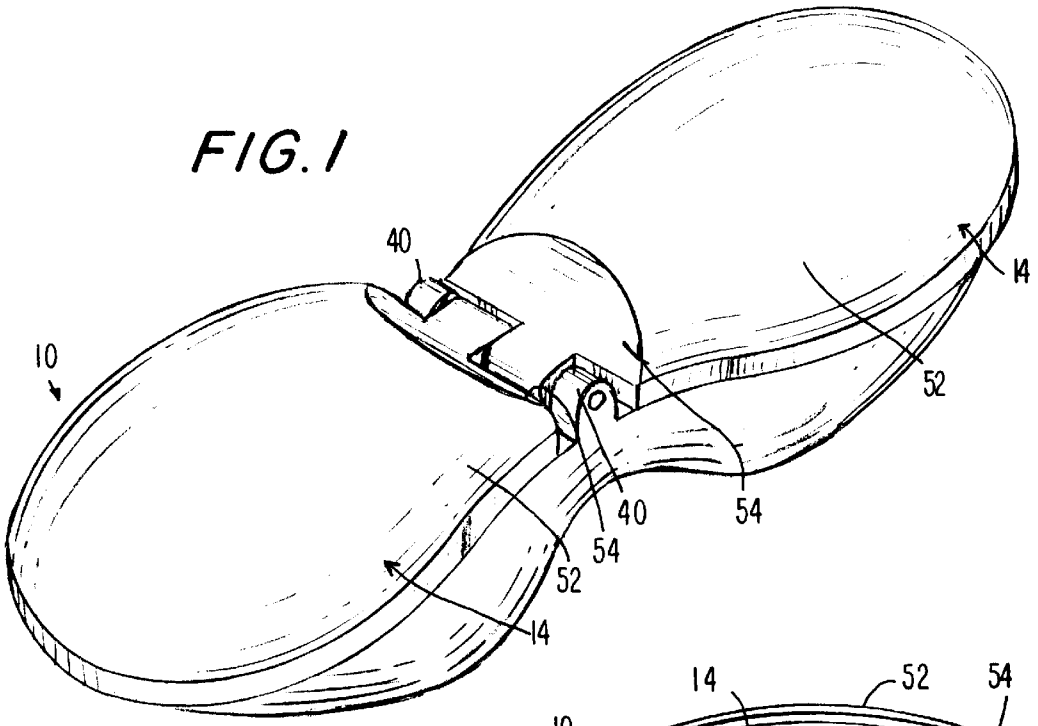
FIG. 1 is a top perspective view of a first embodiment of a contact lens holder in accordance with the invention.
Figure 2:
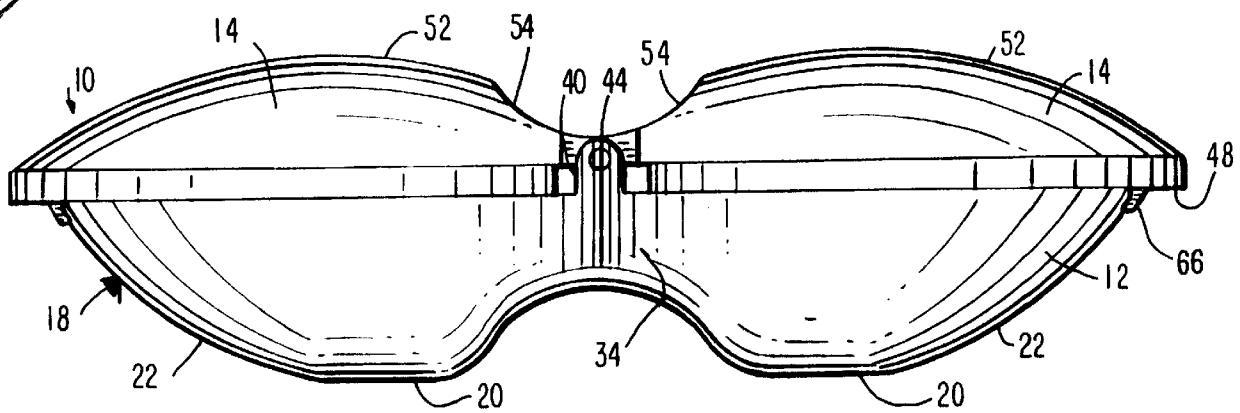
FIG. 2 is a front view of the contact lens holder shown in FIG. 1.
Figure 3:
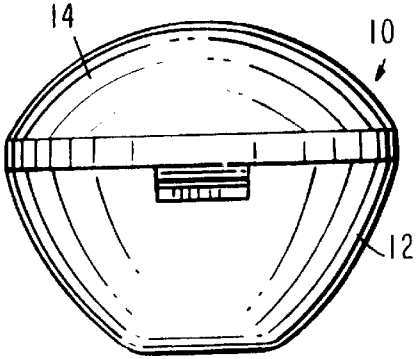
FIG. 3 is a side view of the contact lens holder shown in FIG. 1.
Figure 4:
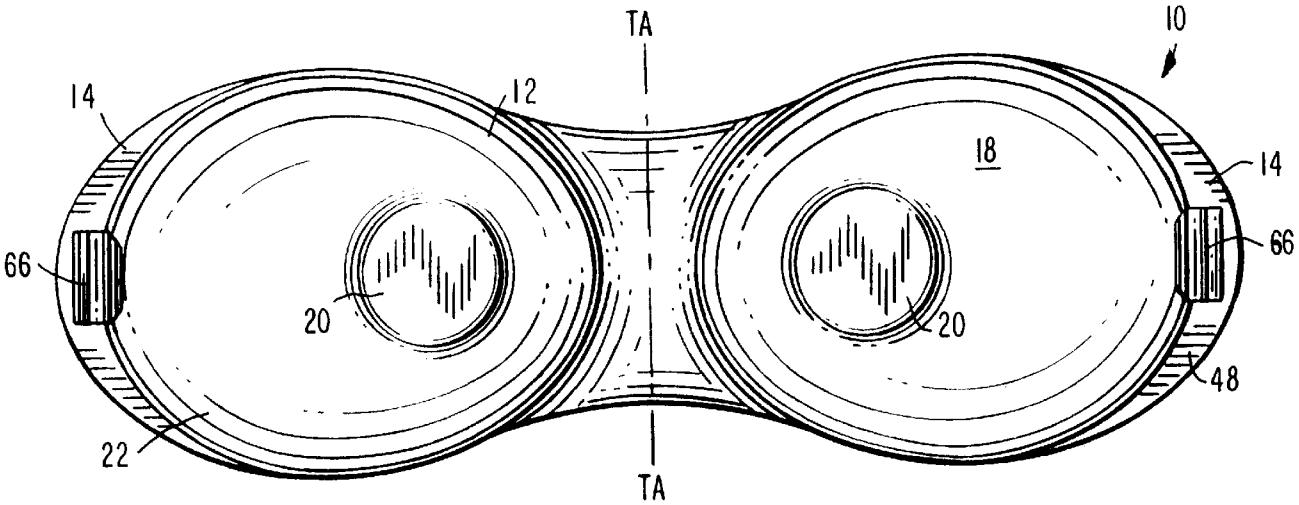
FIG. 4 is a bottom view of the contact lens holder shown in FIG. 1.

Referring to the accompanying drawings wherein like reference characters designate identical or corresponding parts throughout the several views, a first embodiment of a contact lens holder in accordance with the present invention is shown in FIGS. 1–16 and designated generally as 10. In this embodiment, contact lens holder 10 includes a housing comprised of a one-piece elongate body member 12 and a pair of identical covers 14 pivotally mounted on the body member 12. Body member 12 has a generally planar upper surface 16 and a lower surface 18 which is composed of two flat, coplanar surfaces 20 and an arcuate surface 22 contiguous with the two flat surfaces 20. The body member 12 is substantially symmetrical about a transverse axis TA extending through a center of the body member 12.

A pair of oval cups 24 are arranged on each body member, one on each side of the transverse axis TA. The oval shape of each cup 24 provides a larger length LL along the longitudinal axis than the largest length LT in the transverse direction to facilitate easier removal and insertion of the contact lens as will be discussed below (see FIG. 9). In other words, the elongation of the cup 24 along the longitudinal axis thereof enables insertion of a greater portion of a finger (and nail if the nail projects beyond the tip of the finger) of the contact lens wearer into the cup 24. This elongation is particularly important when the wearer has long fingernails. The oval shape is in comparison to conventional cups in contact lens holders wherein the cups are hemispherical and often do not enable adequate insertion of the contact lens wearer's finger into the interior thereof especially when the wearer has long fingernails.

Figure 9:
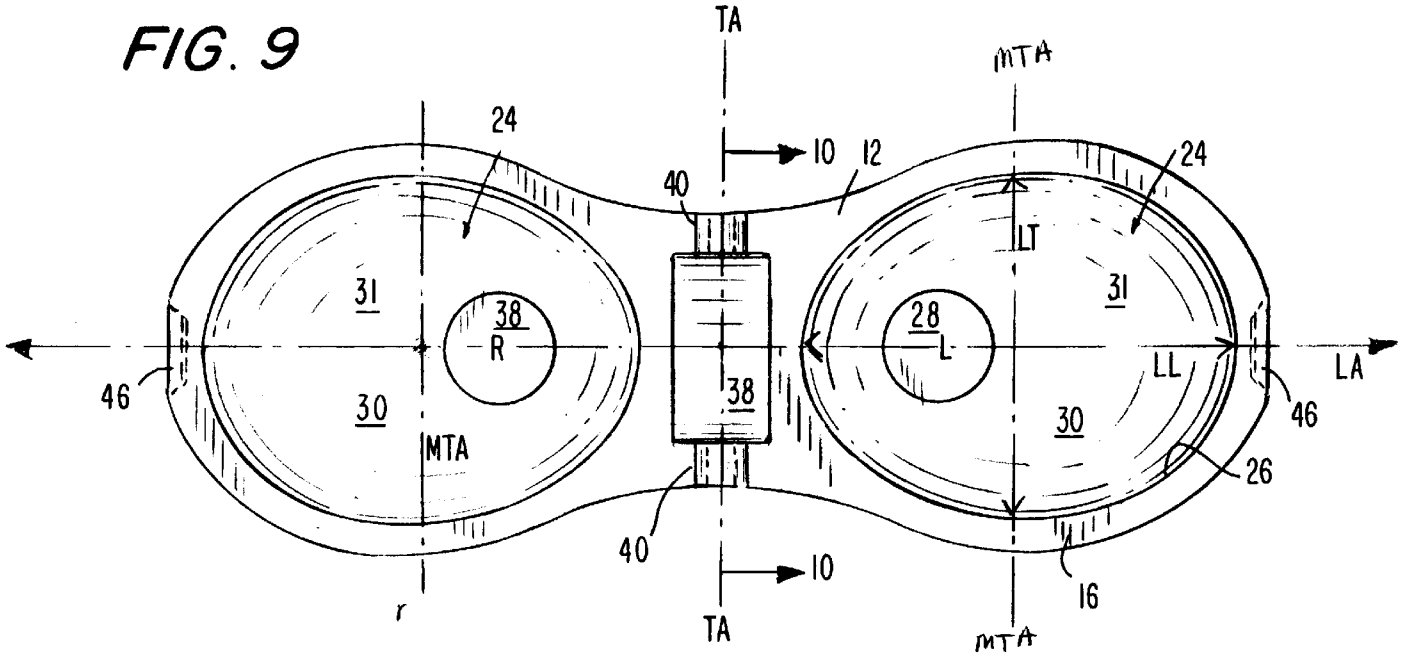
FIG. 9 is a top view of a body member forming part of the contact lens holder shown in FIG. 1.

More specifically, each cup 24 extends from an oval opening 26 in the upper surface 16 of the body member 12 and is defined by a round or elliptical, flat bottom surface 28 and an arcuate surface 30 extending around and contiguous with the flat bottom surface 28. The flat bottom surface 28 is not in the center of the cup 24 but rather is longitudinally offset from a center of the oval opening 26, i.e., the bottom surface 26 is situated closer to the edge of the oval opening 26 along the longitudinal axis proximate the transverse axis TA than to the edge of the oval opening 26 along the longitudinal axis at the adjacent end of the body member 12. In view of this "offset" of the flat bottom surface 28, arcuate surface 30 is provided with an elongated portion 31, the advantage of which is discussed below. The oval opening 26 in the upper surface 16 of the body member 12 is composed of two halves of two different ellipses. One half of the first ellipse 32 extends from a point proximate a central portion 34 of the body member 12 to a transverse axis MTA in the middle of the cup 24 and one half of the second ellipse 36 extends from the transverse axis MTA to the end of the body member 12 (FIG. 9). The arcuate surface 30 has a varied radius of curvature which is at a minimum along the longitudinal axis LA between the bottom surface 28 and the central portion 34 of the body member 12 and at a maximum along the longitudinal axis LA between the bottom surface 28 and the respective end of the body member 12. The arcuate surface 30 is symmetrical about the longitudinal axis LA. The bottom surface 28 of one cup 24 is provided with the designation "R", and is thus intended to receive the contact lens for the right eye, and the bottom surface 28 of the other cup 24 is provided with the designation "L", to receive the contact lens of the left eye (see FIG. 9).

Furthermore, the depth of the cup 24 is dimensioned relative to at least the longitudinal length LL so that the angle a of the cup 24 over the elongated portion 31 of the arcuate surface 30 (FIG. 6) is lower than in conventional hemispherical cups. This lower angle is directly related to the size of the elongate portion 31 of the arcuate surface 30, i.e., the longer the elongated surface 31 with an invariable depth of the cup 24, the larger the angle $\alpha$.

The bottom surface 28 and portions of the arcuate surface 30 defining the cups 24 are spaced from opposed portions of the flat surfaces 20 and arcuate surfaces 22 of the lower surface 18 of the body member 12 to thereby define walls having a substantially uniform thickness.

Figure 10:
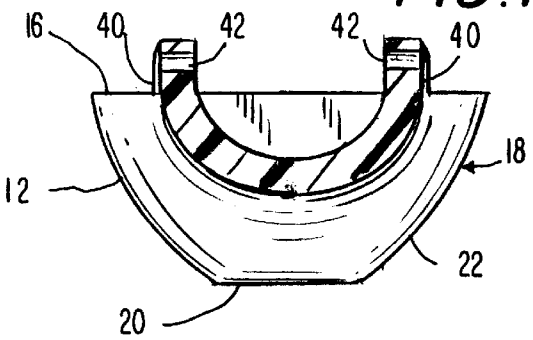
FIG. 10 is a cross-sectional view of the body member shown in FIG. 9 taken along the line 10—10 of FIG. 9.
Figure 11:
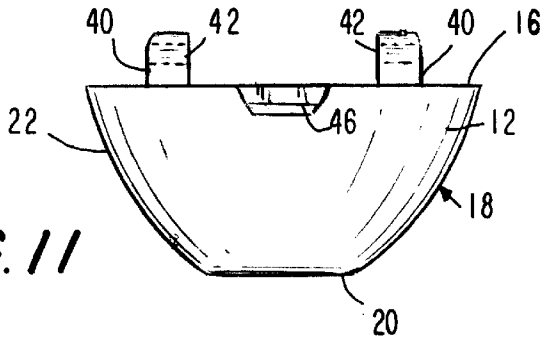
FIG. 11 is a side view of the body member shown in FIG. 9.

As shown most clearly in FIGS. 9–11, the central portion 34 of the body member 12 includes a rectangular-shaped recess 38 and opposed vertical walls 40 extending upward from the upper surface 16 on the sides of the recess 38. Each wall 40 has a through channel 42 for retaining a shaft 44 which will extend between the walls 40 over the recess 38 and pivotally couple the covers 14 to the body member 12 (see FIG. 6).

A transverse slot 46 is arranged at each end of the body member 12 below the upper surface 16 thereof for reasons which will be explained below (FIG. 11).

Figure 7:
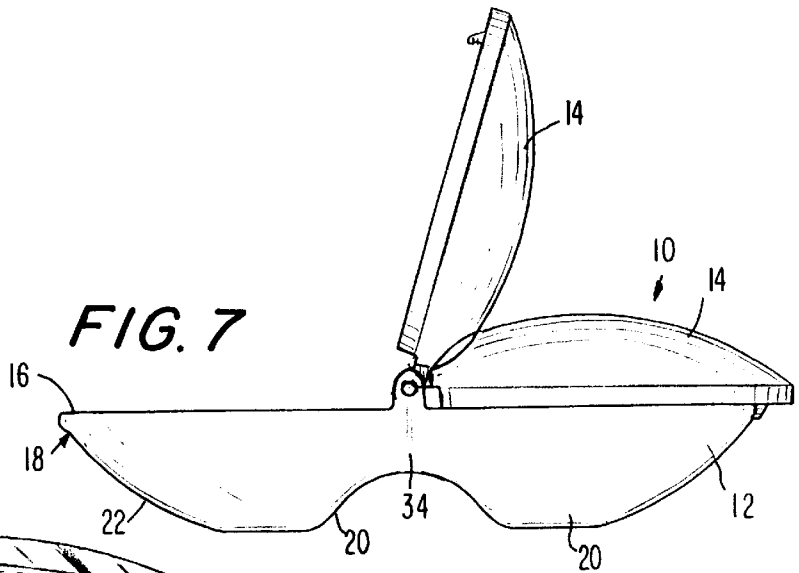
FIG. 7 is a side view of the contact lens holder shown in FIG. 1 with a cover in an open position.
Figure 12:
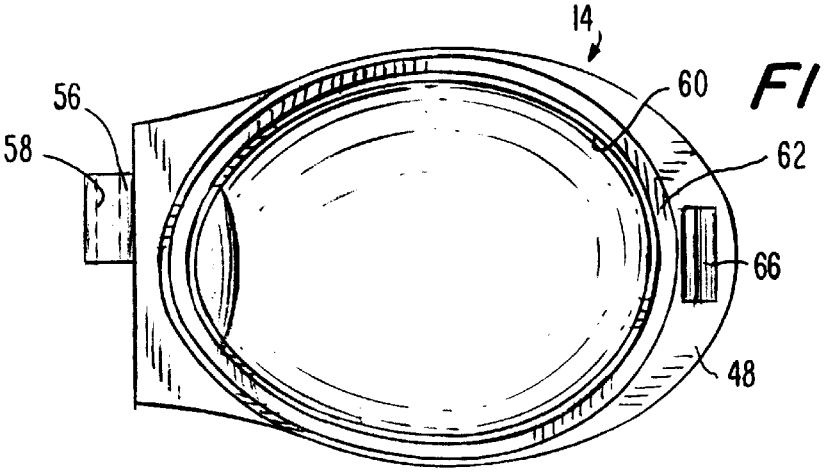
FIG. 12 is a bottom view of a cover forming part of the contact lens holder shown in FIG. 1.
Figure 14:
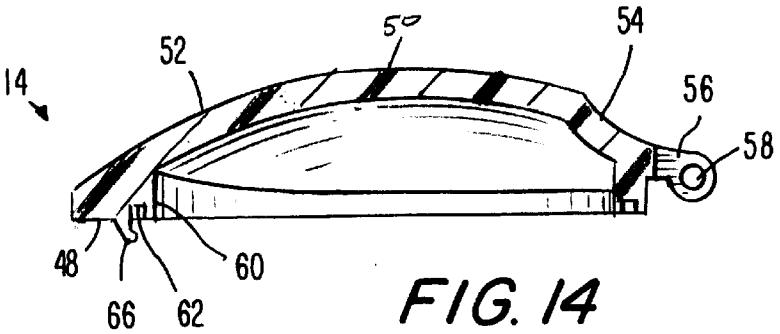
FIG. 14 is a cross-sectional view of the cover shown in FIG. 13 taken along the line 14—14 of FIG. 13.
Figure 13:
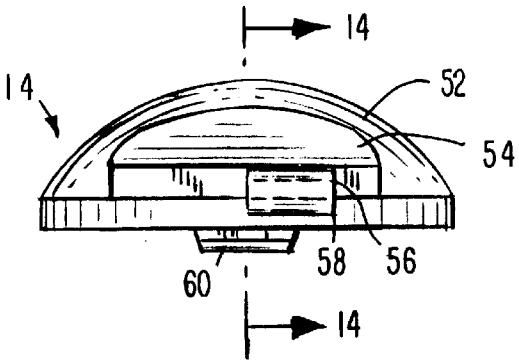
FIG. 13 is a side view of the cover shown in FIG. 12.
Figure 17:
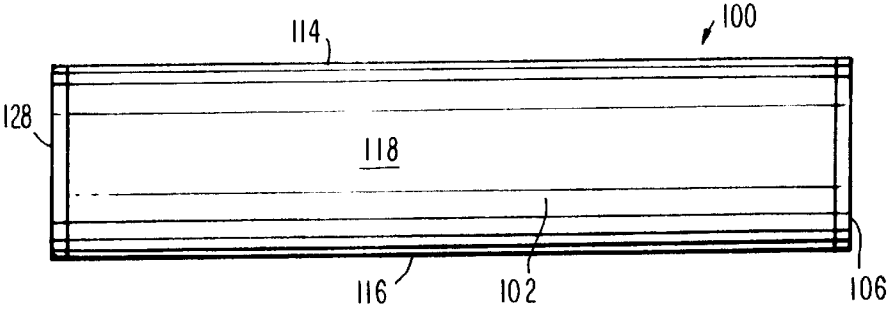
FIG. 17 is a front view of a second embodiment of a contact lens holder in accordance with the invention.
Figure 18:
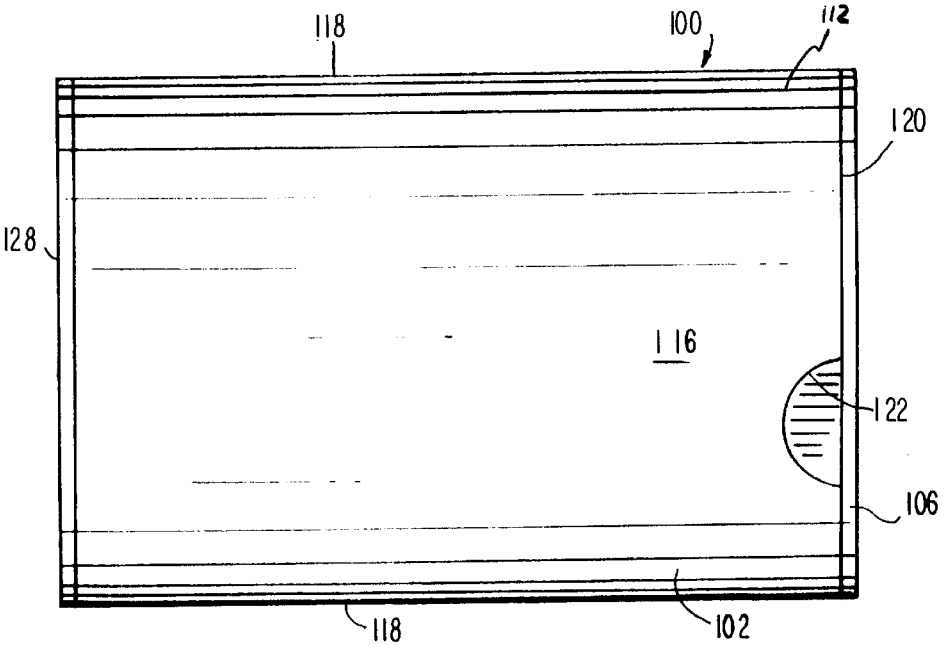
FIG. 18 is a bottom view of the contact lens holder shown in FIG. 17.

The covers 14 are mounted on the body member 12 to pivot between a first position in which a respective cup 24 is covered (shown most clearly in FIG. 2) and a second position in which the respective cup 24 is accessible (shown in FIG. 7). As shown in FIGS. 12–14, each cover 14 has a planar, elliptical lower surface 48 and an arcuate upper surface 50 including a convex portion 52 and a concave portion 54 contiguous with the convex portion 52. A flange 56 is provided on each cover 24 alongside the concave portion 54 and has a channel 58 through which the shaft 44 is inserted. The presence of the concave portions 54 enables the covers 14 to be opened to a greater extent.

Figure 8:
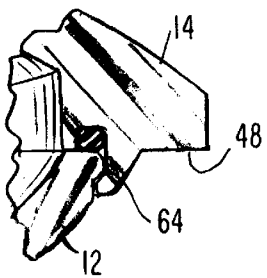
FIG. 8 is an enlarged view of the portion designated 8 shown in FIG. 6.
Figure 5:
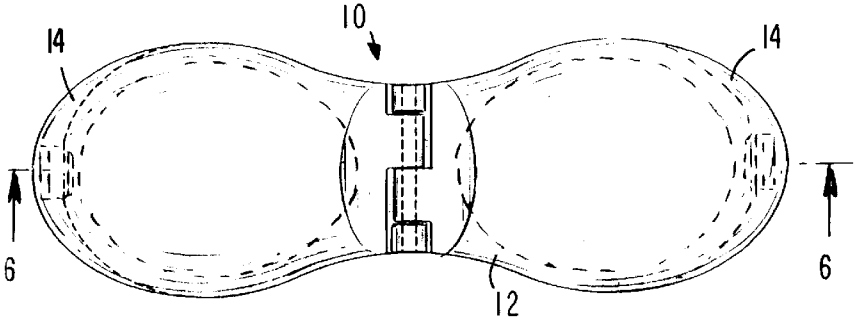
FIG. 5 is a top view of the contact lens holder shown in FIG. 1 showing the cups in dotted lines.
Figure 6:
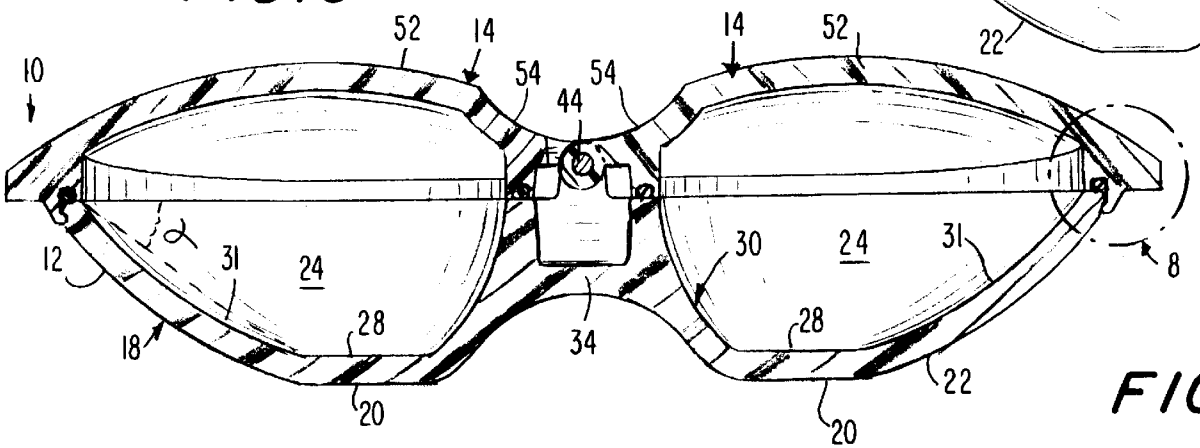
FIG. 6 is a cross-sectional view of the contact lens holder shown in FIG. 1 taken along the line 6—6 of FIG. 5.

An oval opening 60 is formed in the lower surface 48 of the covers 14 and communicates with an upwardly oriented oval cup. A seal groove 62 is also formed in the lower surface 48 of the covers 14 around the opening 60 therein. The opening 60 in the lower surface 48 is substantially coextensive with the oval opening 26 in the upper surface 16 of the body member 12. As shown in FIG. 8, a seal ring 64, preferably made of rubber or equivalent elastic material, is situated in each seal groove 62 so that when the covers 14 are in the closed position, the seal ring 64 engages the upper surface 16 of the body member 12 and thus serves to seal the covers 14 to the body members 12 and prevent leakage of contact lens solution from the cups 24.

Each cover 14 includes a projecting latch 66 at an end opposite to the end at which the flange 56 is situated. The location and dimensions of the latch 66 in each cover 14 are such that each latch 66 fits tightly in a respective transverse slot 46 on the body member 12. In this manner, a secure engagement of the covers 14 to the body member 12 is obtained which will prevent unintentional separation of the covers 14 from engagement with the body member 12.

The body member 12 and covers 14 may be made of any suitable, non-porous material capable of retaining conventional contact lens solutions, such as a rigid plastic. The body members 12 and covers 14 may also be provided with a fanciful design to enhance the aesthetic appeal of the contact lens holder 10. For example, the contact lens holder 10 may have a floral design, a pattern of different colors whereby the covers each are of one color and the body member of a different color, a contemporary design such as newsprint. In the alternative, the contact lens holder 10 may be of a single color.

To assemble the contact lens holder 10, the body member 12 and covers 14 are first formed, e.g., in a mold if made of plastic. A shaft 44 made of a suitably rigid material is provided having a length substantially equal to the width of the central portion 34 of the body member 12. The shaft 44 is first inserted through the channel 42 on one wall 40 of the body member 12, the covers 14 are positioned so that the channels 58 in the flanges 56 aligns with the channel 42 on the wall 40 of the body member and then the shaft 44 is forced through the channels 58 in the flanges 56 and into the channel 42 in the opposed wall 40 of the body member 12. The shaft 44 is secured in that position by appropriate means.

In use, for storing contact lens 68 in the holder 10 after wearing the contact lens, the user flips one cover 14 up to expose the respective cup 24 (according to generally accepted convention, the cup having the designation "R" on the bottom wall thereof should be exposed first since the right contact lens is removed first), and places the body member 12 on a preferably flat surface. The wearer removes the right contact lens 68, cleans it and places it in the cup 24, and then fills the cup 24 with the appropriate contact lens storage solution, usually until the contact lens 68 is completely immersed in the solution. During filling with the contact lens solution, the contact lens 68 will move until it rests on the bottom surface 28 (as shown in FIGS. 15 and 16). An optional disinfecting solution may be added to the contact lens storage solution. The cup 24 is then closed by pushing the cover 14 downward until the latch 66 is received in the transverse slot 46 in the body member 12. The wearer then does the same procedure with the left contact lens. The contact lens 68 are thus retained in the holder 10 until subsequent use. Leakage of the contact lens solution from the cups 24 is prevented by means of the presence of the seal ring 64 in the groove 62 in the lower surface 48 of the covers 14 and which engages the upper surface 16 of the body member 12.

To access the contact lens 68 for a subsequent insertion onto the wearer's eyes, the covers 14 are alternatingly flipped up by removing the latches 66 on the covers 14 from the respective transverse slot 46 in the body member 12 to expose the cups 24 and the contact lens 68 contained therein. To remove the contact lens 68 from the respective cup 24 and realize the advantages provided by the invention, the wearer places his or her finger on the contact lens 66 and slides it upward from its position resting on the bottom surface 28 along the elongated portion 31 of the arcuate surface 30 so that the contact lens 68 is gradually removed from the cup 24 (FIG. 16). The presence of the elongated portion 31 of the arcuate surface 30 enables a larger portion of the wearer's finger to enter into the cups 24. As such, even women with long fingernails can easily remove contact lenses from the cups 24 (see FIG. 16). After removal from the cups 24, the contact lenses are rinsed and inserted onto the eyes in a conventional manner.

FIGS. 17–27 show a second embodiment of a contact lens holder in accordance with the invention which is designated generally as 100 and comprises a housing having an elongate outer housing part 102 defining an interior space 104, an inner housing part 106 slidable into the interior space 104 of the outer housing part 102 and which defines a pair of oval contact lens-receiving cups 108 and a pair of covers 110 for covering the cups 108. The inner housing part 106 is substantially coextensive with the outer housing part 102. The sliding movement of the inner housing part 106 into the outer housing part 102 is represented by arrow A in FIG. 21.

Figure 25:
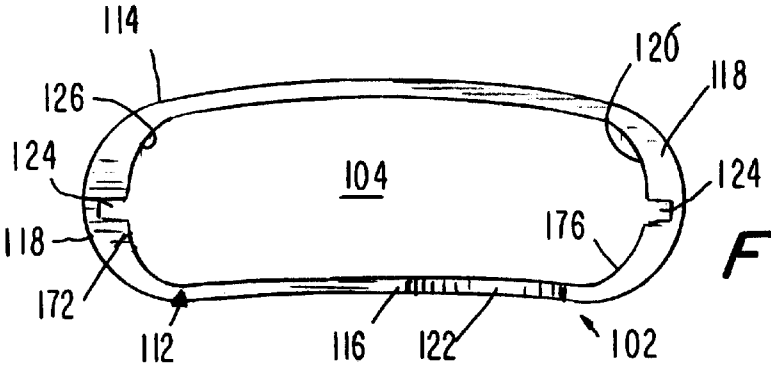
FIG. 25 is a side view of an outer housing part of the contact lens holder shown in FIG. 17.

Outer housing part 102 comprises a tubular member 112 having a curved top wall 114, a curved bottom wall 116 substantially parallel to the top wall 114 and first and second semi-cylindrical side walls 118 extending between ends of the top and bottom walls 114,116. The top wall 114 and bottom wall 116 are both convex when viewed from above. The top wall 114, bottom wall 116 and side walls 118 are substantially coextensive with each another and define the interior space 104 receivable of the inner housing part 106. One edge 120 of the bottom wall 116 has an arcuate indent 122 for enabling the inner housing part 106 to be grasped and removed from the interior space 104 of the outer housing part 102. As shown in FIG. 25, a longitudinal slot 124 is formed on the inner surface 126 of each side wall 118 and, as discussed in greater detail below, serves to guide the inner housing part 106 into and out of the interior space 104 in the outer housing part 102

Outer housing part 102 also includes an end cap 128 which is arranged at one end of the outer housing part 102 to close that end of the outer housing part 102. The indent 122, is formed at the opposite end and the opposite end remains open to enable the inner housing part 106 to be slid into and out of the interior space 104 of the outer housing part 102. The end cap 128 has a side wall 130 having the same shape as the tubular member 112 so that the side wall 130 is contiguous with the top, bottom and side walls 114,116,118 of the tubular member 112 when engaged therewith. End cap 128 includes a projection 132 on the inner surface 134 which frictionally engages opposed inner surfaces 136 of the top and bottom walls 114,116 to secure the end cap 128 to the tubular member 112 and thereby form the outer housing part 102 (FIG. 21).

The outer surfaces of the tubular member 112 and end cap 128 are smooth without any ridges, nooks or crannies. As such, the outer housing part 102 can be easily kept clean and free of any accumulation of dirt.

Figure 24:
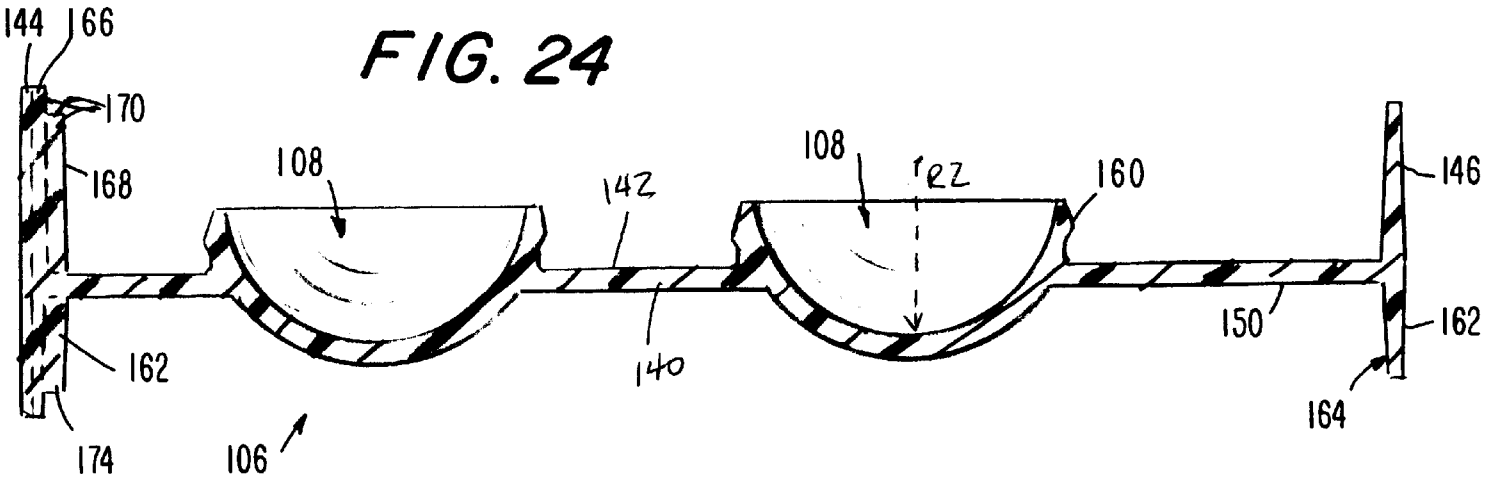
FIG. 24 is a cross-sectional view of an inner housing part of the contact lens holder shown in FIG. 17 taken along the line 21—21 of FIG. 20.

As shown most clearly in FIGS. 24, 26 and 27, inner housing part 106 includes a base member 138 having a substantially planar portion 140 having longitudinally extending lateral edges 141, an upper surface 142, the two oval contact lens-receiving cups 108 which extend downward from the upper surface 142, a first end wall 144 arranged at one longitudinal end of the planar portion 140, a second end wall 146 arranged at a second longitudinal end of the planar portion 140 and lower longitudinal ridges 148 projecting from a lower surface 150 of the planar portion 140. A transverse wall 159 is joined to the lower surface 150 along the longitudinal axis of each cup 108.

Each cup 108 extends from an oval opening 152 defined by an upper rim 160 extending from the upper surface 142 of the planar portion 140 of the inner housing part 106. Rim 160 is formed by opposed, parallel sides 154 and semi-circular sides 156. Each cup 108 is defined by an arcuate surface 158 having a constant radius of curvature R1 along the longitudinal axis LA of the cup 108 (see FIG. 27), a constant radius of curvature R2 along the transverse axis TA of the cup 108 (see FIG. 24) and a variable radius of curvature between the longitudinal axis LA and transverse axis TA. The radius of curvature R1 is greater than the radius of curvature R2 so that the cup 108 has a larger longitudinal dimension than transverse dimension and thereby provides the cup 108 with its oval shape. Arcuate surface 158 is situated at least partially below the lower surface 150 of the planar portion 140 so that the cups 108 project below the planar portion 140.

The depth of the cups 108 is dimensioned relative to at least the length along the longitudinal axis LA so that the angle $\alpha$ of each cup 108 (FIG. 27) is lower than in conventional hemispherical cups. This lower angle results from the larger longitudinal dimension than the transverse dimension.

The planar portion 140 is joined to the end walls 144,146 at a middle location between the upper and lower surfaces of the end walls 144,146 so that a lower portion of each end wall 144,146 forms a lower transverse ridge 162. The lower longitudinal ridges 148 and transverse ridge 162 cooperate to define a lower rim 164. The distance by which the cup 108 extends below the lower surface 150 of the planar portion 140 is less than, or substantially equal to, the height of the lower rim 164 so that the inner housing part 106 is able to firmly rest on a flat surface thereby providing a stable footing therefor.

First end wall 144 has a first exterior portion 166 and a second interior portion 168, both of which have the same general shape as the cross-sectional shape of the tubular member 112 of the outer housing part 102. The first exterior portion 166 is dimensioned so that an inner surface 170 abuts against an edge surface 172 of the tubular member 112. In this manner, when the inner housing part 106 is within the interior space defined by the outer housing part 102, the end wall 144 is still accessible and can be grasped to slide the inner housing part 106 out of the outer housing part 102, and thus enable access to the cups 108. Access to the end wall 144 is also facilitated by the indent 122 in the bottom wall 116 of the tubular member 112. The second interior portion 168 is dimensioned to fit within the outer housing part 102 so that an edge surface 174 is adapted to frictionally engage opposed inner surfaces 176 of the top, bottom and side walls 114,116,118 of the tubular member 112 of the outer housing part 102 to secure the inner housing part 106 to the outer housing part 102 and prevent unintentional removal of the inner housing part 106 from the outer housing part 102. The second end wall 146 has the same shape as the cross-sectional shape of the tubular member 112 of the outer housing part 102 but is dimensioned to fit within the outer housing part 102.

As shown in FIGS. 21–23, the contact lens holder 100 also includes covers 178 for covering the cups 108. Each cover 178 has an oval planar portion 180, a rim 182 arranged at an edge 184 of the planar portion 180 and a tab 186 contiguous with the planar portion 180. The rim 182 of each cover 178 is dimensioned to fit over the upper rim 160 of a respective one of the cups 108 in the inner housing part 106. The covers 178 may include a designation to enable differentiation between the contact lens for the right eye and the contact lens for the left eye, e.g., "R" and "L" (not shown).

The upper rim 160 of each cup 108 and the rim 182 of each cover 178 are provided with cooperating sealing and securing means for sealing the interior of the cups and securing the covers to the cups, namely a peripheral ridge 188 on the outer surface 190 of the upper rim 160 of each cup 108 and a complementary groove 192 in the inner surface 194 of the rim 182 of each cover 178. The sealing and securing means prevent unintentional separation of the covers 178 from the cups 108 and seal the interior of the cups 108 to thereby prevent leakage of contact lens solution from the cups 108. The covers 178 may be attached to the inner housing part 106.

The outer and inner housing parts 102,106 and covers 178 may be made of any suitable material, such as molded plastic. The outer surfaces of the end wall 144 of the inner housing part 106 and the outer housing part 102 may also be provided with a fanciful design or arrangement of colors to enhance the aesthetic appeal of the contact lens holder 100. For example, the tubular member 112 of the outer housing part 102 may be a single color whereas the end wall 144 of the inner housing part 106 and the outer surface of the end cap 128 are a different color. A logo may also be placed on the tubular member 112 of the outer housing part 102.

In use, for storing the contact lens in the holder 100 after wearing the contact lens, the wearer slides the inner housing part 106 out of the outer housing part 102 and places the inner housing part 102 on a preferably flat surface with the cups 108 facing upward. The wearer first removes one contact lens, cleans and rinses it and places it in the one of the cups 108, and then fills the cup 108 with contact lens storage solution, usually until the contact lens is completely immersed in the solution. The wearer then does the same with the other contact lens. An optional disinfecting solution may be added to the contact lens storage solution. The covers 178 are then placed over the appropriate cups 108 until the projections 188 on the upper rim 160 of the cups 108 is received in the groove 192 on the inner surface 194 of the covers 178. The cover with the designation "R" is placed over that cup with the contact lens for the right eye and the cover with the designation "L" is placed over the other cup with the contact lens of the left eye. The inner housing part 106 is then slid into the outer housing part 102 by grasping the end wall of the body member of the inner housing part 106 and pushing the inner housing part 106 until the inner surface 170 of the exterior portion 166 of the end wall 144 engages the edge surface 172 of the tubular member 112. The insertion of the inner housing part 106 into the outer housing part 102 is guided by the insertion of the longitudinally extending lateral edges 141 of the planar portion 140 of the inner housing part 106 into the complementary slots 124 on the inner surface 126 of the side walls 118 of the tubular member 112 of the outer housing part 102. The contact lenses are thus retained in the holder 100 until subsequent use.

Leakage of the contact lens solution from the cups is prevented by means of the cooperation of the ridges on the upper rim of the cups and the grooves on the rim of the covers. Furthermore, in the unlikely event that contact lens solution leaks out of the cups, additional leakage prevention is also provided by the frictional engagement of the end wall of the outer housing part 102 to the tubular member 112 as well as by the frictional engagement of the end wall of the inner housing part 106 to the tubular member 112. Thus, it is very unlikely that any contact lens solution will flow from the cups out of the contact lens holder and into a purse or pocket in which the contact lens holder 100 is being carried.

To remove the contact lens for a subsequent use, the inner housing part 106 is slid out of the outer housing part 102, placed on a surface and the covers 178 are lifted out of engagement with the cups 108. To this end, the wearer may grasp the tab 186 on each cover 178 and then lift the covers 178 off of the cup 108 to thereby expose the cups 108 and contact lenses contained therein. To remove each contact lens from the respective cup 108 and realize the advantages provided by the invention, the wearer places his or her finger on the contact lens and slides it upward in the longitudinal direction of the cup 108. The oval shape of the cups 108 enables a larger portion of the wearer's finger to enter into the cups 108. After removal from the cups 108, the contact lenses are rinsed and inserted onto the eyes in a conventional manner.

The examples provided above are not meant to be exclusive. Many other variations of the present invention would be obvious to those skilled in the art, and are contemplated to be within the scope of the appended claims. For example, although two different housings including the oval cups in accordance with the invention are shown, other housings may be constructed with oval cups within the scope and spirit of the invention. Also, although two different constructions of oval cups are shown, other oval cups may be used in accordance with the invention.

I claim:

1. A contact lens holder, comprising a housing including a pair of oval contact lens-receiving cups, each of said cups being elongated in a longitudinal direction such that said cups have a longitudinal dimension and a transverse dimension smaller than said longitudinal dimension, and cover means for covering said cups.

2. The contact lens holder of claim 1, wherein said housing comprises a molded body member having a substantially planar upper surface and an arcuate lower surface.

3. The contact lens holder of claim 2, wherein each of said cups extends from an oval opening in said upper surface of said body member and is defined by a flat bottom surface and an arcuate surface extending around and contiguous with said bottom surface, said bottom surface being longitudinally offset relative to a center of said oval opening such that said arcuate surface has an elongated portion along the longitudinal axis between said bottom surface and an edge of said oval opening proximate an end of said body member.

4. The contact lens holder of claim 3, wherein said arcuate surface has an varied radius of curvature which is at a minimum along the longitudinal axis between said bottom surface and the central transverse axis and at a maximum along the longitudinal axis between said bottom surface and the respective end of said body member.

5. The contact lens holder of claim 4, wherein said bottom surface of one of said cups is provided with the designation "R" and said bottom surface of the other of said cups is provided with the designation "L".

6. The contact lens holder of claim 1, further comprising cooperating latching means arranged on said cover means and said housing for latching said cover means to said housing.

7. The contact lens holder of claim 6, wherein said cover means comprise a pair of covers, said latching means comprise a transverse slot arranged at longitudinal ends of said housing below an upper surface of said housing and a projecting latch arranged on said covers and adapted to fit tightly in a respective one of said transverse slots.

8. The contact lens holder of claim 1, wherein said cover means comprise a pair of covers, each of said covers being pivotally mounted to said housing.

9. The contact lens holder of claim 8, further comprising hinge means for pivotally mounting said covers to said housing, said hinge means comprising each of said covers having a flange having a channel therethrough, said housing comprising a member having opposed walls projecting from an upper surface of said member and including a channel therein, and a shaft extending through said channels in said walls and said channels in said flanges of said covers to thereby couple said covers to said member.

10. The contact lens holder of claim 8, wherein each of said covers has a planar, elliptical lower surface and an arcuate upper surface, an upwardly oriented oval cup being defined in said lower surface.

11. The contact lens holder of claim 1, further comprising seal means arranged on said cover means for sealing said cups when said cover means cover said cups.

12. The contact lens holder of claim 11, wherein said cover means comprise a pair of covers having a lower surface adapted to abut against an upper surface of said housing, said seal means comprising a groove formed in said lower surface of said covers and a seal ring situated in said groove.

13. The contact lens holder of claim 1, wherein said housing comprises an outer housing part defining an interior space and an inner housing part slidable into said interior space of said outer housing part, said cups being arranged on said inner housing part.

14. The contact lens holder of claim 13, wherein said outer housing part comprises a tubular member having a top wall, a bottom wall substantially parallel to said top wall and side walls extending between said top and bottom walls, said side walls including a longitudinal slot for guiding said inner housing part into said interior space of said outer housing part.

15. The contact lens holder of claim 14, wherein said outer housing part further comprises an end cap arranged at one end of said outer housing part whereby said inner housing part is insertable into said interior space of said outer housing part from an opposite end of said outer housing part.

16. The contact lens holder of claim 13, wherein said inner housing part includes a base member having a substantially planar portion having an upper surface, said cups being arranged on said planar portion to extend downward from said upper surface.

17. The contact lens holder of claim 16, wherein each of said cups includes an upper rim extending above said upper surface of said planar portion.

18. The contact lens holder of claim 16, wherein each of said cups extends from an oval opening in said upper surface of said planar portion, said oval opening being defined by opposed, parallel sides and semi-circular sides connecting said opposed, parallel sides.

19. The contact lens holder of claim 16, wherein said inner housing part further comprises a first end wall arranged at a first longitudinal end of said planar portion, a second end wall arranged at a second longitudinal end of said planar portion and lower longitudinal ridges projecting from a lower surface of said planar portion.

20. The contact lens holder of claim 19, wherein said first end wall has a first exterior and a second interior portion having the same shape as the cross-sectional shape of said outer housing part, said first exterior portion being dimensioned such that an inner surface abuts against an edge surface of said outer housing part, said second interior portion being dimensioned to fit within said outer housing part such that an edge surface is adapted to frictionally engage opposed inner surfaces of said outer housing part to thereby secure said inner housing part to said outer housing part.

21. The contact lens holder of claim 13, wherein each of said cups is defined by an arcuate surface having a constant radius of curvature along a longitudinal axis of said cup, a constant radius of curvature along the transverse axis of said cup and a variable radius of curvature between the longitudinal axis and transverse axis.

22. The contact lens holder of claim 13, wherein said cover means comprise a pair of covers, each of said covers having a oval planar portion, a rim arranged at an edge of said planar portion and a tab contiguous with said planar portion.

23. The contact lens holder of claim 13, wherein said inner and outer housing parts and said cover means are made of plastic.

24. A contact lens holder, comprising a housing including a pair of oval contact lens-receiving cups, each of said cups having a longitudinal dimension and a transverse dimension smaller than said longitudinal dimension, and cover means for covering each of said cups, said housing comprising a molded body member having a substantially planar upper surface and an arcuate lower surface, each of said cups extending from an oval opening in said upper surface of said body member and being defined by a flat bottom surface and an arcuate surface extending around and contiguous with said bottom surface, said bottom surface being longitudinally offset relative to a center of said oval opening such that said arcuate surface has an elongated portion along the longitudinal axis between said bottom surface and an edge of said oval opening proximate an end of said body member.

25. A contact lens holder, comprising a housing including a pair of oval contact lens-receiving cups, each of said cups having a longitudinal dimension and a transverse dimension smaller than said longitudinal dimension, a pair of covers for covering said cups, and cooperating latching means arranged on said covers and said housing for latching said covers to said housing, said latching means comprising a transverse slot arranged at longitudinal ends of said housing below an upper surface of said housing and a projecting latch arranged on said covers and adapted to fit tightly in a respective one of said transverse slots.

26. A contact lens holder, comprising a housing including a pair of oval contact lens-receiving cups, each of said cups having a longitudinal dimension and a transverse dimension smaller than said longitudinal dimension, and cover means for covering said cups, said cover means comprising a pair of covers, each of said covers being pivotally mounted to said housing.

27. A contact lens holder, comprising a housing including a pair of oval contact lens-receiving cups, each of said cups having a longitudinal dimension and a transverse dimension smaller than said longitudinal dimension, cover means for covering said cups, and seal means arranged on said cover means for sealing said cups when said cover means cover said cups.

28. A contact lens holder, comprising a housing including a pair of oval contact lens-receiving cups, each of said cups having a longitudinal dimension and a transverse dimension smaller than said longitudinal dimension, said housing comprising an outer housing part defining an interior space and an inner housing part slidable into said interior space of said outer housing part, said cups being arranged on said inner housing part, said outer housing part comprising a tubular member having a top wall, a bottom wall substantially parallel to said top wall and side walls extending between said top and bottom walls, said side walls including a longitudinal slot for guiding said inner housing part into said interior space of said outer housing part, and cover means for covering said cups.

29. A contact lens holder, comprising a housing including a pair of oval contact lens-receiving cups, each of said cups having a longitudinal dimension and a transverse dimension smaller than said longitudinal dimension, said housing comprising an outer housing part defining an interior space and an inner housing part slidable into said interior space of said outer housing part, said cups being arranged on said inner housing part, said inner housing part including a base member having a substantially planar portion having an upper surface, said cups being arranged on said planar portion to extend downward from said upper surface, each of said cups extending from an oval opening in said upper surface of said planar portion, said oval opening being defined by opposed, parallel sides and semi-circular sides connecting said opposed, parallel sides, and cover means for covering said cups.

30. A contact lens holder, comprising a housing including a pair of oval contact lens-receiving cups, each of said cups having a longitudinal dimension and a transverse dimension smaller than said longitudinal dimension, said housing comprising an outer housing part defining an interior space and an inner housing part slidable into said interior space of said outer housing part, said cups being arranged on said inner housing part, said inner housing part including a base member having a substantially planar portion having an upper surface, said cups being arranged on said planar portion to extend downward from said upper surface, said inner housing part further comprising a first end wall arranged at a first longitudinal end of said planar portion, a second end wall arranged at a second longitudinal end of said planar portion and lower longitudinal ridges projecting from a lower surface of said planar portion, said first end wall having a first exterior and a second interior portion having the same shape as the cross-sectional shape of said outer housing part, said first exterior portion being dimensioned such that an inner surface abuts against an edge surface of said outer housing part, said second interior portion being dimensioned to fit within said outer housing part such that an edge surface is adapted to frictionally engage opposed inner surfaces of said outer housing part to thereby secure said inner housing part to said outer housing part, and cover means for covering said cups.

31. A contact lens holder, comprising a housing including a pair of oval contact lens-receiving cups, each of said cups having a longitudinal dimension and a transverse dimension smaller than said longitudinal dimension, said housing comprising an outer housing part defining an interior space and an inner housing part slidable into said interior space of said outer housing part, said cups being arranged on said inner housing part, each of said cups being defined by an arcuate surface having a constant radius of curvature along a longitudinal axis of said cup, a constant radius of curvature along the transverse axis of said cup and a variable radius of curvature between the longitudinal axis and transverse axis, and cover means for covering said cups.

* * * * *

UNITED STATES PATENT AND TRADEMARK OFFICE
Certificate

Patent No. 6,170,664 B1

Patented: January 9, 2001

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Irit Dar, Fair Lawn, NJ (US); Martha Davis, San Francisco, CA (US); Stuart Harvey Lee, Forest Hills, NY (US); and Andrea Ruggiero, NY (US).

Signed and Sealed this Twenty-second Day of February 2011.

TSE CHEN
*Supervisory Patent Examiner*
Art Unit 3737
Technology Center 3700